US008592126B2

(12) United States Patent
Ueno et al.

(10) Patent No.: US 8,592,126 B2
(45) **Date of Patent: *Nov. 26, 2013**

(54) LIQUID DEVELOPER AND IMAGE-FORMING APPARATUS

(75) Inventors: Yoshihiro Ueno, Shiojiri (JP); Masahiro Oki, Iruma (JP); Tsutomu Teraoka, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 273 days.

This patent is subject to a terminal disclaimer.

(21) Appl. No.: 13/009,160

(22) Filed: Jan. 19, 2011

(65) Prior Publication Data

US 2011/0177448 A1 Jul. 21, 2011

(30) Foreign Application Priority Data

Jan. 20, 2010 (JP) ..... 2010-010504

(51) Int. Cl.
*G03G 9/13* (2006.01)

(52) U.S. Cl.
USPC ..... 430/114; 430/115

(58) Field of Classification Search
USPC ..... 430/114, 115, 112; 399/233
See application file for complete search history.

(56) References Cited

U.S. PATENT DOCUMENTS

| | | | | |
|---|---|---|---|---|
| 5,700,395 | A | 12/1997 | Thetford et al. | |
| 6,165,258 | A | 12/2000 | Asada | |
| 6,627,709 | B2 | 9/2003 | Endo | |
| 6,806,013 | B2 * | 10/2004 | Morrison et al. | 430/114 |
| 8,206,878 | B2 * | 6/2012 | Ueno et al. | 430/45.2 |
| 2005/0069348 | A1 * | 3/2005 | Fujita et al. | 399/237 |
| 2007/0141504 | A1 | 6/2007 | Miyakawa | |
| 2009/0181318 | A1 * | 7/2009 | Oki et al. | 430/114 |
| 2010/0014894 | A1 * | 1/2010 | Ueno et al. | 399/233 |

FOREIGN PATENT DOCUMENTS

| | | | |
|---|---|---|---|
| JP | 10-254186 | A | 9/1998 |
| JP | 3332961 | B2 | 10/2002 |
| JP | 2007-219380 | | 8/2007 |

OTHER PUBLICATIONS

American Chemical Society (ACS) File Registry No. RN 18312-04-4, copyright 2012 ACS on STN, which entered STN on Nov. 16, 1984.*

American Chemical Society (ACS) File Registry No. RN 6107-56-8, copyright 2013 ACS on STN, which entered STN on Nov. 16, 1984.*

* cited by examiner

*Primary Examiner* — Janis L Dote
(74) *Attorney, Agent, or Firm* — DLA Piper LLP (US)

(57) ABSTRACT

A liquid developer contains a liquid insulator formed of a liquid hydrocarbon, toner particles formed by chemically modifying surfaces of mother toner particles formed of a material containing a rosin-based resin and a polyester resin with a polyalkyleneimine, and a metal soap dissolved in the liquid insulator.

7 Claims, 2 Drawing Sheets

1000

LIQUID DEVELOPER AND IMAGE-FORMING APPARATUS

BACKGROUND

1. Technical Field

The present invention relates to liquid developers and image-forming apparatuses.

2. Related Art

Known developers used for developing an electrostatic latent image formed on a latent image carrier include a liquid developer containing a toner formed of a material containing a colorant, such as a pigment, and a binder resin and an electrically insulating liquid carrier (liquid insulator) in which the toner is dispersed.

In general, polyester resins are widely used as binder resins for toner particles in liquid developers (see, for example, JP-A-2007-219380). Polyester resins are highly transparent and, when used as binder resins, show images with vivid colors and also have superior fusion properties.

However, polyester resins themselves normally have negative charging properties and are therefore difficult to apply to toner particles (liquid developer) with positive charging properties.

SUMMARY

An advantage of some aspects of the invention is that it provides a liquid developer having superior positive charging properties and development efficiency and an image-forming apparatus using such a liquid developer.

A liquid developer according to a first aspect of the invention contains a liquid insulator formed of a liquid hydrocarbon, toner particles formed by chemically modifying surfaces of mother toner particles formed of a material containing a rosin-based resin and a polyester resin with a polyalkyleneimine, and a metal soap dissolved in the liquid insulator.

Thus, a liquid developer having superior positive charging properties and development efficiency can be provided.

Preferably, in the liquid developer according to the first aspect of the invention, the relationship $0.8 \leq A/B \leq 1.0$ is satisfied, where A is the dielectric constant of the liquid insulator in which the metal soap is dissolved and B is the dielectric constant of the toner particles.

In this case, dielectric polarization can be more reliably prevented for particularly superior development efficiency.

Preferably, in the liquid developer according to the first aspect of the invention, the content of the metal soap in the liquid insulator in which the metal soap is dissolved is 0.1% to 10% by weight.

In this case, the dielectric constant of the liquid component of the liquid developer can be more efficiently controlled.

Preferably, in the liquid developer according to the first aspect of the invention, the metal soap is zirconium octylate.

In this case, the dielectric constant of the liquid component of the liquid developer can be easily controlled to prevent dielectric polarization more effectively for particularly superior development efficiency.

Preferably, in the liquid developer according to the first aspect of the invention, the polyalkyleneimine has a weight average molecular weight of 600 to 200,000.

In this case, the surfaces of the mother toner particles can be modified (chemically modified) more effectively. In addition, the polyalkyleneimine causes steric hindrance with its relatively long molecular chain to effectively prevent aggregation of the toner particles, thus effectively improving the dispersion stability of the toner particles.

Preferably, in the liquid developer according to the first aspect of the invention, the polyalkyleneimine is polyethylene imine.

In this case, the surfaces of the mother toner particles can be chemically modified more effectively to provide the toner particles with even superior long-term dispersion stability and positive charging properties.

Preferably, the liquid developer according to the first aspect of the invention further contains a dispersant having an amine value of zero.

In this case, the dispersant provides the toner particles with superior dispersion stability while ensuring the positive charging properties thereof more stably.

An image-forming apparatus according to a second aspect of the invention includes a plurality of developing sections that form a plurality of monochrome images using a plurality of liquid developers of different colors, an intermediate transfer section onto which the monochrome images formed by the developing sections are sequentially transferred to form an intermediate transfer image such that the transferred monochrome images are superimposed on each other, a secondary transfer section that transfers the intermediate transfer image onto a recording medium to form an unfused color image on the recording medium, and a fusing section that fuses the unfused color image onto the recording medium. The liquid developers each contain a liquid insulator formed of a liquid hydrocarbon, toner particles formed by chemically modifying surfaces of mother toner particles formed of a material containing a rosin-based resin and a polyester resin with a polyalkyleneimine, and a metal soap dissolved in the liquid insulator.

Thus, an image-forming apparatus capable of forming an image with high resolution and vivid colors can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
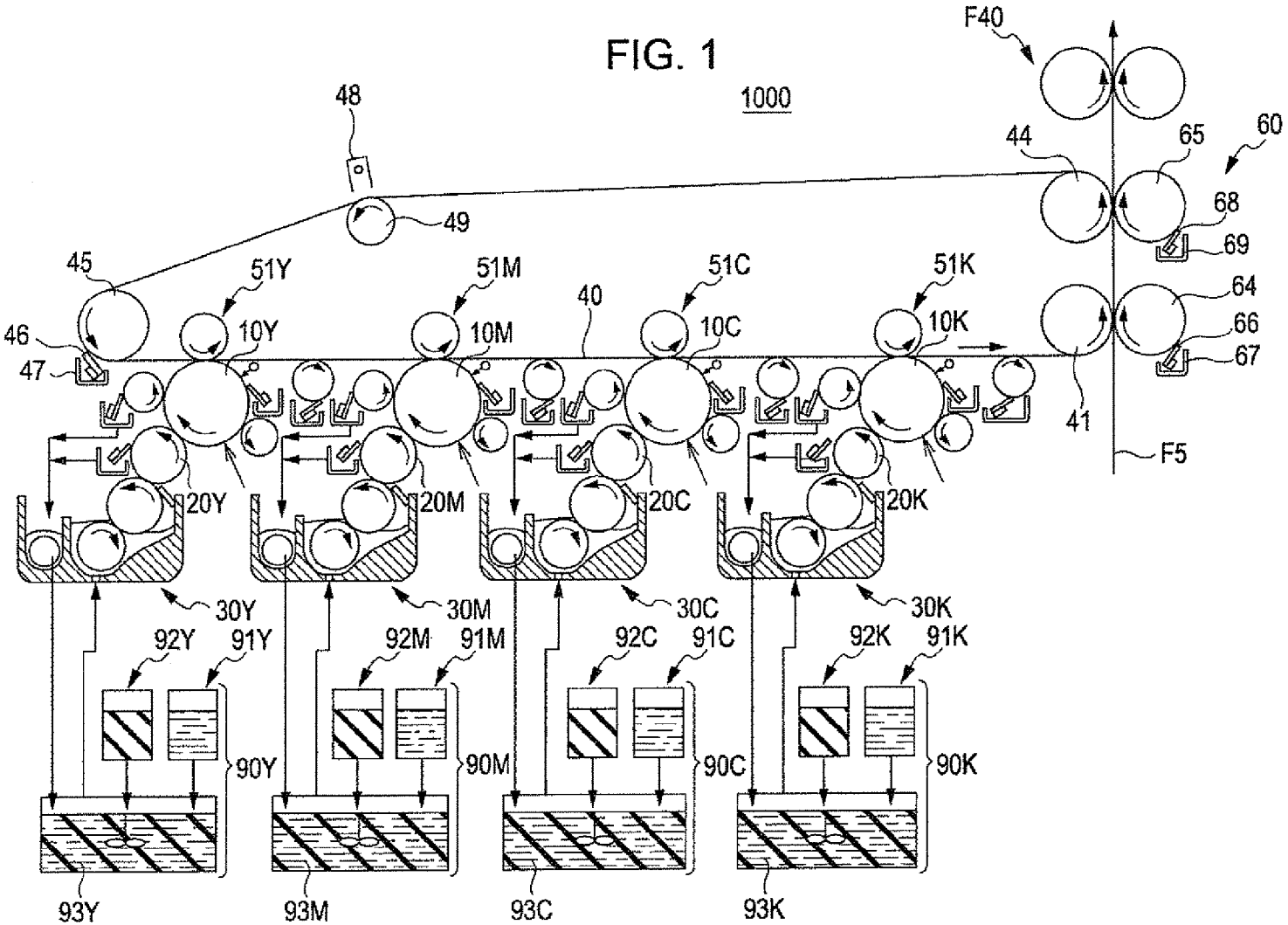
FIG. 1 is a schematic diagram of an example of an image-forming apparatus to which liquid developers according to the invention are applied.

Preferred embodiments of the invention will now be described in detail.

Liquid Developer

First, a liquid developer according to an embodiment of the invention will be described.

The liquid developer according to this embodiment contains a liquid insulator formed of an aliphatic hydrocarbon, toner particles formed by modifying the surfaces of mother toner particles formed of a material containing a rosin-based resin and a polyester resin with a polyalkyleneimine, and a metal soap dissolved in the liquid insulator.

In general, polyester resins are widely used as binder resins for toner particles. Polyester resins are highly transparent and, when used as binder resins, show images with vivid colors and also have superior fusion properties.

However, polyester resins themselves normally have negative charging properties and are therefore difficult to apply to toner particles (liquid developer) with positive charging properties.

As a result of an intensive study, the inventors have invented a liquid developer having superior positive charging properties through the use of toner particles formed by modifying the surfaces of mother toner particles formed of a material containing a rosin-based resin and a polyester resin with a polyalkyleneimine.

The liquid insulator is a dielectric, and the toner particles are also an insulator (dielectric). If an electric field is applied to the liquid developer containing such materials, they have an electric dipole due to dielectric polarization, with the result that the fine particles are linearly oriented along the electric field. In this case, the fine particles may form a relatively robust linear structure that obstructs electrophoresis, thus decreasing the development efficiency.

As a result of an additional intensive study, the inventors have found that such dielectric polarization can be prevented for superior development efficiency by, as described above, dissolving a metal soap in a liquid insulator in which toner particles chemically modified with a polyalkyleneimine are dispersed.

The individual components will now be described in detail.

Toner Particles

The toner particles are formed by chemically modifying the surfaces of mother toner particles formed of a material containing a rosin-based resin and a polyester resin with a polyalkyleneimine.

Mother Toner Particles

The mother toner particles contain at least a binder resin (resin material) and a colorant.

1. Resin Material (Binder Resin)

The mother toner particles are formed of a material mainly containing a resin material.

In this embodiment, the mother toner particles contain a polyester resin and a rosin-based resin as the resin material.

Polyester Resin

Polyester resins, as described above, are highly transparent and show images with vivid colors when used as binder resins.

In addition, polyester resins have functional groups that can be chemically modified with a polyalkyleneimine, described later. However, if the toner particles are formed only of a polyester resin, the toner particles have insufficient positive charging properties because the surfaces thereof cannot be chemically modified with a sufficient amount of polyalkyleneimine. Accordingly, a rosin-based resin, described later, can be used in combination to chemically modify the surfaces of the toner particles with a sufficient amount of polyalkyleneimine while ensuring the above properties derived from the polyester resin. Thus, the resultant liquid developer has superior positive charging properties.

The softening point of the polyester resin is preferably, but is not limited to, 50° C. to 130° C., more preferably 50° C. to 120° C., and most preferably 60° C. to 115° C. The term "softening point" as used herein refers to a temperature at which softening begins in a measurement using a Koka-type flow tester (manufactured by Shimadzu Corporation) at a heating speed of 5° C./min and a die orifice diameter of 1.0 mm.

In addition, the acid value of the polyester resin is preferably 5 to 20 mg KOH/g, more preferably 5 to 15 mg KOH/g.

The content of the polyester resin in the resin material is preferably 50% to 99% by weight, more preferably 60% to 95% by weight. In this case, the surfaces of the toner particles can be chemically modified with a sufficient amount of polyalkyleneimine while ensuring the above properties derived from the polyester resin. Thus, the resultant liquid developer has particularly superior positive charging properties.

Rosin-Based Resin

Rosin-based resins are advantageous in providing the toner with superior fusion properties for recording media and can be easily and reliably modified (chemically modified) with a polyalkyleneimine. In other words, rosin-based resins have numerous functional groups (acidic groups) highly reactive with a polyalkyleneimine, described later. Accordingly, after a rosin-based resin is modified with a polyalkyleneimine, the polyalkyleneimine combines chemically with the rosin-based resin so that it negligibly comes off from the modified rosin-based resin. That is, in the liquid developer according to this embodiment, the polyalkyleneimine combines firmly with the rosin-based resin (or polyester resin) contained in the toner particles. This provides the toner particles with superior dispersibility and dispersion stability (long-term dispersion stability) in the liquid insulator and superior positive charging properties as well as superior fusion properties.

Examples of rosin-based resins include rosin-modified phenolic resins, rosin-modified maleic resins, rosin-modified polyester resins, fumaric-modified rosin resins, and ester gum, which can be used alone or in a combination of two or more.

The softening point of the rosin-based resin described above is preferably 60° C. to 190° C., more preferably 65° C. to 170° C., and most preferably 70° C. to 160° C. In this case, the fusion properties and thermal storage stability of the toner particles can both be ensured at a higher level while providing the toner particles with superior long-term dispersion stability and charging properties.

In addition, the weight average molecular weight of the rosin-based resin is preferably 500 to 100,000, more preferably 1,000 to 80,000, and most preferably 1,000 to 50,000. In this case, the fusion properties and thermal storage stability of the toner particles can both be ensured at a higher level while providing the toner particles with superior long-term dispersion stability and charging properties.

In addition, the acid value of the rosin-based resin is preferably 40 mg KOH/g or less, more preferably 30 mg KOH/g or less, and most preferably 5 to 25 mg KOH/g. In this case, the surfaces of the mother toner particles can be chemically modified with the polyalkyleneimine more effectively. Thus, the fusion properties and thermal storage stability of the toner particles can both be ensured at a higher level while providing the toner particles with particularly superior long-term dispersion stability and charging properties.

In addition, the content of the rosin-based resin in the resin material is preferably 1 to 50% by weight, more preferably 5% to 40% by weight. In this case, the fusion properties and thermal storage stability of the toner particles can both be ensured at a higher level while providing the toner particles with particularly superior long-term dispersion stability and charging properties.

The mother toner particles may further contain a known resin other than the polyester resin and the rosin-based resin described above.

2. Colorant

The mother toner particles may further contain a colorant. Examples of colorants include, but are not limited to, known pigments and dyes.

3. Other Components

The toner particles may further contain other components. Examples of such components include a known wax and a magnetic powder.

Other examples of the constituent materials (components) of the mother toner particles include zinc stearate, zinc oxide, cerium oxide, silica, titanium oxide, iron oxide, fatty acids, and fatty acid metal salts.

Polyalkyleneimine

A polyalkyleneimine is a compound having numerous amino groups that can react with acidic groups derived from the resin material (polyester resin and rosin-based resin) on the surfaces of the toner particles to chemically modify the surfaces of the toner particles.

After the polyalkyleneimine adheres chemically to (combines with) the surfaces of the toner particles, the surfaces of the toner particles has numerous amino groups, which have positive charging properties. Thus, the resultant liquid developer has superior positive charging properties. That is, the amino groups derived from the polyalkyleneimine attract cations so that the liquid developer has superior positive charging properties. The term "modification (chemical modification) with a polyalkyleneimine" means that at least some of the amino groups of the polyalkyleneimine react chemically with at least some of the acidic groups derived from the resin material (mainly carboxyl groups) on the surfaces of the toner particles to form covalent bonds (amide bonds), or means that the amino groups of the polyalkyleneimine form ionic bonds with the acidic groups of the resin material.

The polyalkyleneimine does not easily come off from the surfaces of the toner particles because it adheres chemically to the surfaces of the toner particles. Thus, the toner particles maintain their superior positive charging properties over an extended period of time and can be stably dispersed in the liquid insulator over an extended period of time.

The above advantageous effects are achieved by chemically modifying the surfaces of the mother toner particles with the polyalkyleneimine; they are not achieved by the mere presence of the polyalkyleneimine in the liquid developer.

Examples of polyalkyleneimines include polyethyleneimine, polypropyleneimine, polybutyleneimine, and polyisopropyleneimine. Among others, polyethyleneimine is preferably used. In this case, the surfaces of the mother toner particles can be chemically modified more effectively to provide the toner particles with even superior long-term dispersion stability and positive charging properties.

The weight average molecular weight of the polyalkyleneimine is preferably 600 to 200,000, more preferably 10,000 to 70,000. If the weight average molecular weight of the polyalkyleneimine falls within such a range, the surfaces of the mother toner particles can be modified (chemically modified) more effectively. In addition, the polyalkyleneimine causes steric hindrance with its relatively long molecular chain to effectively prevent aggregation of the toner particles, thus effectively improving the dispersion stability of the toner particles.

Shape and Other Properties of Toner Particles

The average particle size of the toner particles formed of the materials described above is preferably 0.5 to 3 μm, more preferably 1 to 2.5 μm, and most preferably 1 to 2 μm. If the average particle size of the toner particles falls with such a range, the toner particles have small variations in properties. Thus, the liquid developer can be used to form a toner image with sufficiently high resolution while having high reliability as a whole. In addition, the toner particles can be well dispersed in the liquid insulator so that the liquid developer has high storage stability. The term "average particle size" as used herein refers to a volume-based average particle size.

In addition, the dielectric constant of the toner particles is preferably 2.8 to 3.5. In this case, the liquid developer has even superior development efficiency.

The content of the toner particles in the liquid developer is preferably 10% to 60% by weight, more preferably 20% to 50% by weight.

Liquid Insulator

Next, the liquid insulator will be described.

In this embodiment, the liquid insulator is formed of a liquid hydrocarbon.

Liquid hydrocarbons are suitable for use as liquid insulators for liquid developers because they have high insulation, have superior properties including transparency, liquidity, chemical stability, and weather resistance, and are nonvolatile.

A liquid hydrocarbon, however, tends to undergo dielectric polarization, as described above, because it has a lower dielectric constant than the resin material for the toner particles. Such dielectric polarization can be prevented by dissolving a metal soap, described later, to control the dielectric constant of the liquid component of the liquid developer. As a result, a liquid developer having superior positive charging properties and development efficiency can be provided.

The liquid insulator may be any liquid having sufficiently high insulation. Specifically, the liquid insulator preferably has an electrical resistance at room temperature (20° C.) of $1\times10^{9}$ Ωcm or more, more preferably $1\times10^{11}$ Ωcm or more, and most preferably $1\times10^{13}$ Ωm or more.

Examples of liquid hydrocarbons satisfying such conditions include mineral oils such as ISOPAR E, ISOPAR G, ISOPAR H, and ISOPAR L ("ISOPAR" is a trade name of ExxonMobil Chemical Company), SHELLSOL 70 and SHELLSOL 71 ("SHELLSOL" is a trade name of Shell Chemicals), AMSCO OMS and AMSCO 460 Solvent ("AMSCO" is a trade name of American Mineral Spirits Company), and low- and high-viscosity liquid paraffins (such as those from Wako Pure Chemical Industries, Ltd.), and other liquid hydrocarbons such as octane, isooctane, decane, isodecane, decalin, nonane, dodecane, isododecane, cyclohexane, cyclooctane, cyclodecane, benzene, toluene, xylene, and mesitylene, which can be used alone or in a combination of two or more.

Metal Soap

In this embodiment, a metal soap is dissolved in the liquid insulator.

By dissolving a metal soap, the dielectric constant of the liquid component of the liquid developer can be controlled to prevent dielectric polarization for superior development efficiency.

Examples of such metal soaps include NAPHTHEX Cobalt 8%, NAPHTHEX Manganese 8%, NAPHTHEX Zinc 8%, NAPHTHEX Zirconium 4%, NAPHTHEX Magnesium 2%, NIKKA OCTHIX Cobalt 8%, NIKKA OCTHIX Manganese 8%, NIKKA OCTHIX Zinc 8%, NIKKA OCTHIX Zirconium 12%, and NIKKA OCTHIX Tin 14% (all trade names of Nihon Kagaku Sangyo Co., Ltd.), which can be used alone or in a combination of two or more. Of these, NIKKA OCTHIX Zirconium 12% (zirconium octylate) is preferably used. In this case, the dielectric constant of the liquid component of the liquid developer can be easily controlled to prevent dielectric polarization more effectively for particularly superior development efficiency.

The content of the metal soap in the liquid insulator in which the metal soap is dissolved is preferably 0.1% to 10% by weight, more preferably 0.1% to 5% by weight. In this case, the dielectric constant of the liquid component of the liquid developer can be more efficiently controlled.

It is preferable to satisfy the relationship $0.8 \leq A/B \leq 1.0$, where A is the dielectric constant of the liquid insulator in which the metal soap is dissolved and B is the dielectric constant of the toner particles. In this case, dielectric polarization can be more reliably prevented for particularly superior development efficiency.

Dispersant

In addition to the above components, the liquid developer according to this embodiment may further contain a dispersant.

If a dispersant is contained, the toner particles achieve higher dispersion stability.

The dispersant used is preferably, but not limited to, one having an amine value of zero. A dispersant having a certain amine value may inhibit the toner particles from being positively charged. Accordingly, the use of a dispersant having an amine value of zero provides the toner particles with superior dispersion stability while ensuring the positive charging properties thereof more stably.

Examples of such dispersants include ARAKYD 251 and ARAKYD 310 (manufactured by Arakawa Chemical Industries, Ltd.).

The content of the dispersant is preferably 0.1% to 5% by weight. In this case, the dispersion stability of the toner particles can be more efficiently improved.

Method for Producing Liquid Developer

Next, a method for producing a liquid developer according to a preferred embodiment of the invention will be described.

The method for producing a liquid developer according to this embodiment includes a dispersion preparation step of preparing a dispersion containing mother toner particles containing a polyester resin and a rosin-based resin and an aqueous dispersion medium in which the mother toner particles are dispersed; a chemical modification step of mixing the dispersion with a polyalkyleneimine to chemically modify the surfaces of the mother toner particles with the polyalkyleneimine, thus forming toner particles; and a liquid insulator dispersion step of dispersing the toner particles in a liquid insulator.

The individual steps of the method for producing a liquid developer will now be described in detail.

Dispersion Preparation Step (Aqueous Dispersion Preparation Step)

First, a dispersion (aqueous dispersion) is prepared that contains mother toner particles containing a polyester resin and a rosin-based resin and an aqueous dispersion medium in which the mother toner particles are dispersed.

Although the aqueous dispersion may be prepared by any method, it is preferably prepared as a suspension through a resin solution preparation step of preparing a resin solution by dissolving the constituent materials of the mother toner particles (mother particle material), including the rosin-based resin, in an organic solvent; an oil-in-water (O/W) emulsion preparation step of preparing an O/W emulsion through the formation of a water-in-oil (W/O) emulsion by adding an aqueous liquid to the resin solution; a coalescence step of coalescing the dispersoids contained in the O/W emulsion to form coalesced particles; and an organic solvent removal step of removing the organic solvent from the coalesced particles to form mother toner particles. This method provides particularly high dimensional and shape uniformity for the dispersoids contained in the aqueous emulsion. Thus, the toner particles contained in the liquid developer finally obtained have a remarkably sharp particle size distribution and therefore particularly small variations in properties. In the following description, the case where the aqueous dispersion is prepared through the resin solution preparation step, the O/W emulsion preparation step, the coalescence step, and the organic solvent removal step will be taken as a typical example.

Resin Solution Preparation Step

First, a resin solution is prepared by dissolving the resin material and other materials in an organic solvent.

The prepared resin solution contains the constituent materials of the mother toner particles, described above, and the organic solvent, described below.

The organic solvent used may be any organic solvent that dissolves at least part of the resin material, although one having a lower boiling point than an aqueous liquid, described later, is preferably used. In this case, the organic solvent can be easily removed.

In addition, the organic solvent preferably has low compatibility with the aqueous liquid (aqueous dispersion medium), described later (for example, one having a solubility of 30 g or less in 100 g of aqueous liquid at 25°). In this case, the dispersoids formed of the mother particle material can be finely dispersed stably in the O/W emulsion (aqueous emulsion), described later.

The composition of the organic solvent can be appropriately selected depending on, for example, the compositions of the resin material, the colorant, and the aqueous liquid (aqueous dispersion medium).

Examples of such organic solvents include, but are not limited to, ketone solvents such as methyl ethyl ketone (MEK) and aromatic hydrocarbon solvents such as toluene.

The resin solution can be prepared by, for example, mixing the resin material, the colorant, and the organic solvent using, for example, a mixer. Examples of mixers that can be used for preparation of the resin solution include high-speed mixers such as DESPA (manufactured by Asada Iron Works Co., Ltd.) and T.K. ROBOMIX/T.K. HOMO DISPER Model 2.5 (manufactured by PRIMIX Corporation).

The material temperature during the stirring is preferably 20° C. to 60° C., more preferably 30° C. to 50° C.

The solid content of the resin solution is preferably, but is not limited to, 40% to 75% by weight, more preferably 50% to 73% by weight, and most preferably 50% to 70% by weight. If the solid content falls within such a range, the dispersoids in the dispersion (aqueous dispersion), described later, have a higher sphericity (i.e., have a shape closer to a perfect sphere) so that toner particles having appropriate shape can be finally formed more reliably.

To prepare the resin solution, all the constituents of the resin solution to be prepared may be simultaneously mixed, or some of the constituents of the resin solution to be prepared may be mixed in advance to form a mixture (masterbatch) before the mixture (masterbatch) is mixed with the other constituents.

O/W Emulsion Preparation Step

Next, an O/W emulsion is prepared through the formation of a W/O emulsion by adding an aqueous liquid to the resin solution.

The aqueous liquid used may be a liquid mainly containing water.

The aqueous liquid may contain, for example, a solvent highly compatible with water (for example, a solvent having a solubility of 50 parts by weight or more in 100 parts by weight of water at 25° C.).

In addition, an emulsifier may be added to the aqueous liquid as needed. By adding an emulsifier, the aqueous emulsion can be more easily prepared. The emulsifier used is not limited and may be, for example, a known emulsifier.

In addition, the O/W emulsion may be prepared using, for example, a basic material. This allows, for example, the functional groups of the resin material (such as carboxyl groups) to be neutralized, thus providing particularly high shape and dimensional uniformity and dispersibility for the dispersoids in the prepared O/W emulsion. Thus, the resultant toner particles have a particularly sharp particle size distribution. The basic material may be added, for example, to the resin solution or to the aqueous liquid. In addition, the basic material may be added stepwise during the preparation of the O/W emulsion.

Examples of basic materials include sodium hydroxide, potassium hydroxide, and ammonia, which can be used alone or in a combination of two or more.

In addition, the amount of basic material used is preferably one to three times the amount required for neutralizing all carboxyl groups of the resin material (i.e. one to three equivalents), more preferably one to two times the amount required for neutralizing all carboxyl groups of the resin material (i.e. one to two equivalents). This effectively prevents formation of irregular dispersoids and also provides a sharper particle size distribution in the coalescence step, described in detail later.

The aqueous liquid may be added to the resin solution by any method, although the aqueous liquid, containing water, is preferably added to the resin solution while stirring the resin solution. That is, it is preferable to add the aqueous liquid gradually (dropwise) to the resin solution while applying shear to the resin solution using, for example, a mixer to convert a W/O emulsion into an O/W emulsion. This provides particularly high dimensional and shape uniformity for the dispersoids contained in the O/W emulsion. Thus, the toner particles contained in the liquid developer finally obtained have a remarkably sharp particle size distribution and therefore small variations in properties.

Examples of mixers that can be used for preparation of the O/W emulsion include high-speed mixers or high-speed dispersers such as DESPA (manufactured by Asada Iron Works Co., Ltd.), T.K. ROBOMIX/T.K. HOMO DISPER Model 2.5 (manufactured by PRIMIX Corporation), SLASHER (manufactured by Mitsui Mining Co., Ltd.), and CAVITRON (manufactured by Eurotec, Ltd.).

In addition, the aqueous liquid is preferably added to the resin solution with stirring at an impeller tip speed of 10 to 20 m/s, more preferably 12 to 18 m/s. If the impeller tip speed falls within such a range, the O/W emulsion can be efficiently prepared, and the dispersoids contained in the O/W emulsion have particularly small variations in shape and size. This prevents formation of excessively fine dispersoids or coarse particles, thus providing the dispersoids with particularly superior uniform dispersibility.

The solid content of the O/W emulsion is preferably, but is not limited to, 5% to 55% by weight, more preferably 10% to 50% by weight. In this case, the liquid developer can be produced with particularly high productivity while preventing unwanted aggregation of the dispersoids in the O/W emulsion more reliably.

The material temperature during this treatment is preferably 20° C. to 60° C., more preferably 20° C. to 50° C.

Coalescence Step

Next, the dispersoids are coalesced to form coalesced particles. The coalescence of the dispersoids normally proceeds such that the dispersoids containing the organic solvent collide and combine with each other.

The dispersoids are coalesced by adding an electrolyte to the O/W emulsion while stirring the O/W emulsion. Thus, the coalesced particles can be easily and reliably formed. In addition, the particle size and particle size distribution of the coalesced particles can be easily and reliably controlled by adjusting the amount of electrolyte added.

Examples of electrolytes include, but are not limited to, known organic and inorganic water-soluble salts, which can be used alone or in a combination of two or more.

In particular, the electrolyte is preferably a salt of a monovalent cation. In this case, the resultant coalesced particles have a particularly sharp particle size distribution. In addition, the use of a salt of a monovalent cation reliably prevents formation of coarse particles in this step.

In particular, the electrolyte is preferably a sulfate salt (such as sodium sulfate or ammonium sulfate) or a carbonate salt and is particularly preferably a sulfate salt. In this case, the particle size of the coalesced particles can be particularly easily controlled.

The amount of electrolyte added in this step is preferably 0.5 to 3 parts by weight, more preferably 1 to 2 parts by weight, on the basis of 100 parts by weight of the solid contained in the O/W emulsion to which the electrolyte is added. In this case, the particle size of the coalesced particles can be particularly easily and reliably controlled, and formation of coarse particles can be reliably prevented.

In addition, the electrolyte is preferably added in the form of an aqueous solution. In this case, the electrolyte can be quickly diffused through the entire O/W emulsion, and the amount of electrolyte added can be easily and reliably controlled. As a result, coalesced particles having a remarkably sharp particle size distribution can be formed with a desired particle size.

In addition, if the electrolyte is added in the form of an aqueous solution, the concentration of the electrolyte in the aqueous solution is preferably 2% to 10% by weight, more preferably 2.5% to 6% by weight. In this case, the electrolyte can be particularly quickly diffused through the entire O/W emulsion, and the amount of electrolyte added can be easily and reliably controlled. In addition, if the aqueous solution is added, the O/W emulsion has appropriate water content upon completion of the addition of the electrolyte. Thus, the growth speed of the coalesced particles after the addition of the electrolyte can be mildly reduced without impairing the productivity. As a result, the particle size can be more reliably controlled. In addition, unwanted coalescence of coalesced particles can be reliably prevented.

In addition, if the electrolyte is added in the form of an aqueous solution, the rate at which the aqueous electrolytic solution is added is preferably 0.5 to 10 parts by weight per minute, more preferably 1.5 to 5 parts by weight per minute, on the basis of 100 parts by weight of the solid contained in the O/W emulsion to which the aqueous electrolytic solution is added. This avoids unevenness in electrolyte concentration in the O/W emulsion, thus reliably preventing formation of coarse particles. In addition, the coalesced particles have a sharper particle size distribution. Furthermore, by adding the electrolyte at such a rate, the coalescence speed can be particularly easily controlled so that the average particle size of the coalesced particles can be particularly easily controlled, and the liquid developer can be produced with particularly high productivity.

The electrolyte may be added stepwise. In this case, coalesced particles having a desired size can be easily and reliably formed, and the sphericity of the coalesced particles can be reliably and sufficiently increased.

In addition, this step is carried out while stirring the O/W emulsion. In this case, coalesced particles having particularly small variations in shape and size can be formed.

The O/W emulsion can be stirred using a stirring impeller such as an anchor impeller, a turbine impeller, a Pfaudler impeller, a full-zone impeller, a Maxblend impeller, or a half-moon impeller. Of these, a Maxblend impeller and a full-zone impeller are preferred. In this case, the added electrolyte can be quickly and evenly dispersed and dissolved to reliably avoid unevenness in electrolyte concentration. In addition, the dispersoids can be efficiently coalesced while preventing the coalesced particles from collapsing more reliably. As a result, coalesced particles having small variations in shape and size can be efficiently formed.

The impeller tip speed of the stirring impeller is preferably 0.1 to 10 m/s, more preferably 0.2 to 8 m/s, and most preferably 0.2 to 6 m/s. If the impeller tip speed falls within such a range, the added electrolyte can be evenly dispersed and dissolved to reliably avoid unevenness in electrolyte concentration. In addition, the dispersoids can be more efficiently coalesced while preventing the coalesced particles from collapsing still more reliably.

The average particle size of the resultant coalesced particles is preferably 0.5 to 5 more preferably 1.5 to 3 μm. In this case, toner particles having appropriate particle size can be finally formed more reliably.

Organic Solvent Removal Step

Subsequently, the organic solvent is removed from the O/W emulsion (particularly from the dispersoids). Thus, a dispersion (aqueous dispersion) containing mother toner particles and an aqueous dispersion medium in which the mother toner particles are dispersed is obtained.

The organic solvent may be removed by any method. For example, the organic solvent can be removed under reduced pressure. In this case, the organic solvent can be efficiently removed while preventing, for example, deterioration of the constituent materials, including the resin material.

In addition, the treatment temperature during this step is preferably lower than the glass transition point (Tg) of the resin material for the coalesced particles.

In this step, additionally, a defoamer may be added to the O/W emulsion (dispersion). In this case, the organic solvent can be efficiently removed.

Examples of defoamers include mineral oil defoamers, polyether defoamers, silicone defoamers, lower alcohols, higher alcohols, oils and fats, fatty acids, fatty acid esters, and phosphate esters.

The amount of defoamer used is preferably, but is not limited to, 20 to 300 ppm by weight, more preferably 30 to 100 ppm by weight, on the basis of the solid content of the O/W emulsion.

In this step, additionally, at least part of the aqueous liquid may be removed together with the organic solvent.

In this step, additionally, it is not necessary to remove all organic solvent (all organic solvent contained in the dispersion) because residual organic solvent can be sufficiently removed in the step described below.

Cleaning Step (First Cleaning Step)

Next, the mother toner particles obtained as described above are cleaned. Thus, a dispersion (aqueous dispersion) containing cleaned mother toner particles can be obtained.

By carrying out this step, impurities such as the organic solvent can be efficiently removed. By carrying out this step, additionally, the electrolyte, the basic material, and the acidic material used in the above steps and salts produced by acid-base reaction can be efficiently removed. As a result, the mother toner particles finally obtained have particularly low TVOC (total volatile organic compounds). In addition, the liquid insulator has particularly high electrical resistance, and the mother toner particles have improved stability of properties.

This step can be carried out by, for example, separating the mother toner particles by solid-liquid separation (separation from the aqueous liquid) and then redispersing the solid (mother toner particles) in an aqueous liquid (aqueous dispersion medium). The solid-liquid separation and the redispersion of the solid in the aqueous liquid may be repeated multiple times. The cleaning is preferably carried out until a supernatant liquid taken from the dispersion (slurry) prepared by redispersing the solid (mother toner particles) in the aqueous liquid (aqueous dispersion medium) has a conductivity of 20 μS/cm or less.

Chemical Modification Step

Next, the above dispersion (aqueous dispersion) containing the mother toner particles is mixed with a polyalkyleneimine to chemically modify the surfaces of the mother toner particles with the polyalkyleneimine.

This step may be carried out by mixing the aqueous dispersion with the polyalkyleneimine, where the hydrogen ion exponent (pH) of the dispersion (aqueous dispersion) is preferably adjusted to 2 to 8. This allows the reaction between the acidic groups present on the surfaces of the mother toner particles and the polyalkyleneimine to proceed more efficiently so that the polyalkyleneimine combines more firmly with the surfaces of the mother toner particles while reliably avoiding, for example, unwanted deterioration of the constituent materials of the mother toner particles. As a result, the mother toner particles have particularly superior long-term dispersion stability and stability of charging properties. Although the pH of the dispersion (aqueous dispersion) is preferably 2 to 8 in this step, as described above, it is more preferably 2.5 to 6.5 and most preferably 4 to 5. In this case, the above effect appears more significantly.

The pH of the dispersion can be adjusted by, for example, adding 1 N hydrochloric acid.

In addition, after the dispersion is mixed, with the polyalkyleneimine, the mixture is preferably stirred for about one to three hours. This allows the surfaces of the mother toner particles to be more evenly modified (chemically modified).

In addition, the mixture may be stirred either at room temperature or while being heated to about 30° C. to 40° C. By heating, the surfaces of the mother toner particles can be more efficiently modified (chemically modified).

The amount of polyalkyleneimine used in this step is preferably 0.1 to 10 parts by weight, more preferably 0.3 to 6.0 parts by weight, and most preferably 0.5 to 3.0 parts by weight, on the basis of 100 parts by weight of the resin material for the mother toner particles. If the amount of polyalkyleneimine used falls within such a range, it is possible to provide the toner particles with particularly superior long-term dispersion stability and positive charging properties while reliably preventing problems such as dissolution of excess polyalkyleneimine into the liquid insulator in the liquid developer finally obtained.

Cleaning Step (Second Cleaning Step)

Next, the mother toner particles obtained as described above are cleaned.

By carrying out this step, impurities such as the organic solvent can be efficiently removed. As a result, the toner particles finally obtained have particularly low TVOC (total volatile organic compounds). In addition, the toner particles have improved stability of properties.

The polyalkyleneimine, as described above, combines firmly with the mother toner particles containing the polyester resin and the rosin-based resin. Thus, unlike known dispersants used for liquid developers, the polyalkyleneimine is reliably prevented from coming off from the mother toner particles during the cleaning.

This step can be carried out by, for example, separating the toner particles by solid-liquid separation (separation from the aqueous liquid) and then redispersing the solid (toner particles) in an aqueous liquid (aqueous dispersion medium). The solid-liquid separation and the redispersion of the solid in the aqueous liquid may be repeated multiple times.

Drying Step

Subsequently, drying is performed, so that toner particles are obtained. This step reliably and sufficiently reduces the content of water in the toner particles, thus providing particularly superior storage stability and stability of properties for the liquid developer finally obtained.

The drying step may be carried out using, for example, a vacuum dryer (such as RIBOCONE (manufactured by Okawara Corporation) or a Nauta dryer (such as the one manufactured by Hosokawa Micron Corporation)) or a fluidized-bed dryer (such as the one manufactured by Okawara Corporation). In this embodiment, aggregation of the toner particles is reliably prevented after the drying step because the surfaces of the mother toner particles formed of the material containing the rosin-based resin are modified (chemically modified) with the polyalkyleneimine.

Liquid Insulator Dispersion Step

Next, the toner particles obtained as described above are dispersed in a liquid insulator in which a metal soap, as described above, is dissolved. Thus, a liquid developer is obtained.

The toner particles may be dispersed in the liquid insulator by any method, for example, by mixing the liquid insulator and the toner particles using a bead mill or a ball mill.

In addition, the components other than the liquid insulator and the toner particles may be mixed in the dispersion step.

In addition, the dispersion of the toner particles in the liquid insulator may be performed using all liquid insulator for the liquid developer finally obtained or using a portion of the liquid insulator.

In addition, if the toner particles are dispersed in a portion of the liquid insulator, the same liquid used for dispersion may be added as the liquid insulator after the dispersion, or a different liquid may be added as the liquid insulator after the dispersion. In the latter case, the properties, such as viscosity, of the liquid developer finally obtained can be easily adjusted.

For the liquid developer produced by the method described above, the surfaces of the mother toner particles formed of the material containing the polyester resin and the rosin-based resin are modified with the polyalkyleneimine, and the toner particles have small variations in properties such as shape.

Image-Forming Apparatus

Next, an image-forming apparatus according to a preferred embodiment of the invention will be described. The image-forming apparatus according to this embodiment forms a color image on a recording medium using liquid developers, as described above, according to the invention.

Figure 2:
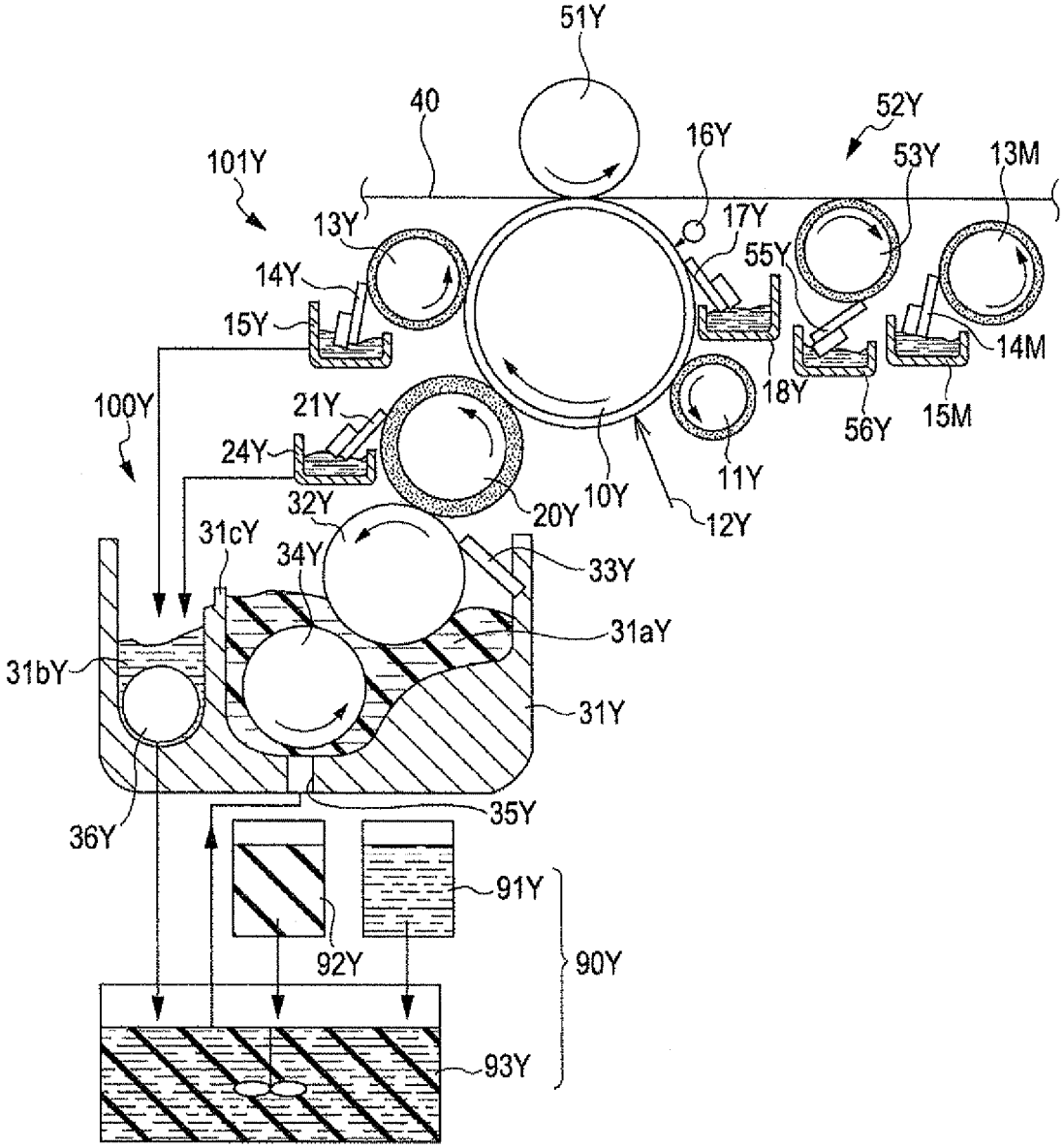
FIG. 2 is a partial enlarged view of the image-forming apparatus shown in FIG. 1.

FIG. 1 is a schematic diagram of an example of an image-forming apparatus to which liquid developers according to the invention are applied, and FIG. 2 is a partial enlarged view of the image-forming apparatus shown in FIG. 1.

Referring to FIGS. 1 and 2, an image-forming apparatus 1000 includes four developing sections 30Y, 30M, 30C, and 30K, an intermediate transfer section 40, a secondary transfer unit (secondary transfer section) 60, a fusing section (fusing unit) F40, and four liquid developer supply sections 90Y, 90M, 90C, and 90K.

The developing sections 30Y, 30M, and 30C have the function of developing latent images with a yellow liquid developer (Y), a magenta liquid developer (M), and a cyan liquid developer (C), respectively, to form monochrome images of the corresponding colors. In addition, the developing section 30K has the function of developing a latent image with a black liquid developer (K) to form a black monochrome image.

The developing sections 30Y, 30M, 30C, and 30K have the same configuration, and the developing section 30Y will therefore be described below.

As shown in FIG. 2, the developing section 30Y includes a photoreceptor 10Y, serving as an example of an image carrier, and, in order of the rotational direction of the photoreceptor 10Y, a charge roller 11Y, an exposure unit 12Y, a developing unit 100Y, a photoreceptor squeeze unit 101Y, a primary transfer backup roller 51Y, a neutralizing unit 16Y, a photoreceptor cleaning blade 17Y, and a developer collector 18Y.

The photoreceptor 10Y includes a cylindrical substrate and a photoreceptor layer disposed on the circumferential surface thereof and formed of a material such as amorphous silicon, and is rotatable about the central axis thereof. In this embodiment, the photoreceptor 10Y rotates clockwise, as indicated by the arrow in FIG. 2.

The photoreceptor 10Y is supplied with the liquid developer by the developing unit 100Y, described later, so that a layer of the liquid developer is formed on the surface of the photoreceptor 10Y.

The charge roller 11Y is a unit for charging the photoreceptor 10Y. The exposure unit 12Y is a unit for irradiating the charged photoreceptor 10Y with a laser beam to form a latent image thereon. The exposure unit 12Y includes, for example, a semiconductor laser, a polygon mirror, and an f-θ lens and irradiates the charged photoreceptor 10Y with a laser beam modulated on the basis of an image signal input from a host computer (not shown) such as a personal computer or a word processor.

The developing unit 100Y is a unit for developing the latent image formed on the photoreceptor 10Y using the liquid developer. The developing unit 100Y will be described in detail later.

The photoreceptor squeeze unit 101Y is disposed opposite the photoreceptor 10Y downstream of the developing unit 100Y in the rotational direction and includes a photoreceptor squeeze roller 13Y, a cleaning blade 14Y for removing the liquid developer from the surface of the photoreceptor squeeze roller 13Y by sliding thereover with pressure, and a developer collector 15Y for collecting the removed liquid developer. The photoreceptor squeeze unit 101Y has the function of collecting excess carrier (liquid insulator) and unwanted fog toner from the developer deposited on the photoreceptor 10Y to increase the proportion of toner particles in the visible image. The photoreceptor squeeze unit also includes a second photoreceptor squeeze roller 13M, a second cleaning blade 14M and a second developer collector 15M.

The primary transfer backup roller 51Y is a unit for transferring the monochrome image formed on the photoreceptor 10Y onto the intermediate transfer section 40, described later.

The neutralizing unit 16Y is a unit for removing residual charge from the photoreceptor 10Y after the primary transfer backup roller 51Y transfers the intermediate transfer image onto the intermediate transfer section 40.

The photoreceptor cleaning blade 17Y is a rubber member abutting the surface of the photoreceptor 10Y and has the function of scraping residual liquid developer off the photoreceptor 10Y after the primary transfer backup roller 51Y transfers the image onto the intermediate transfer section 40.

The developer collector 18Y has the function of collecting the liquid developer scraped off by the photoreceptor cleaning blade 17Y.

The intermediate transfer section 40 is an endless elastic belt member running around a belt drive roller 41 to which a driving force from a motor (not shown) is transmitted and a pair of driven rollers 44 and 45. The intermediate transfer section 40 is rotated counterclockwise by the belt drive roller 41 while being in contact with the photoreceptors 10Y, 10M, 10C, and 10K opposite the primary transfer backup rollers 51Y, 51M, 51C, and 51K, respectively.

In addition, a tension roller 49 applies a certain tension to the intermediate transfer section 40 to remove slack therefrom. The tension roller 49 is disposed downstream of one driven roller 44 in the rotational (movement) direction of the intermediate transfer section 40 and upstream of the other driven roller 45 in the rotational (movement) direction of the intermediate transfer section 40.

The monochrome images of the individual colors formed by the developing sections 30Y, 30M, 30C, and 30K are sequentially transferred onto the intermediate transfer section 40 by the primary transfer backup rollers 51Y, 51M, 51C, and 51K such that the monochrome images of the individual colors are superimposed on each other. Thus, a full-color developer image (intermediate transfer image) is formed on the intermediate transfer section 40.

In this way, the monochrome images are sequentially transferred from the photoreceptors 10Y, 10M, 10C, and 10K onto the intermediate transfer section 40 and are superimposed and carried thereon. The monochrome images are then secondarily transferred together onto a recording medium F5 such as paper, film, or cloth by the secondary transfer unit 60, described later. For improved secondary transfer properties, an elastic belt member is used as the intermediate transfer section 40 to allow the toner images to be transferred onto the surface of the recording medium F5 in the secondary transfer step even if the recording medium F5 is a sheet having a rough surface such as a fibrous surface.

In addition, the intermediate transfer section 40 is provided with a cleaning unit including an intermediate transfer section cleaning blade 46, a developer collector 47, and a noncontact biasing member 48.

The intermediate transfer section cleaning blade 46 and the developer collector 47 are disposed opposite the driven roller 45.

The intermediate transfer section cleaning blade 46 has the function of scraping residual liquid developer off the intermediate transfer section 40 after the secondary transfer unit (secondary transfer section) 60 transfers the toner image onto the recording medium F5.

The developer collector 47 has the function of collecting the liquid developer scraped off by the intermediate transfer section cleaning blade 46.

The noncontact biasing member 48 is disposed at a position opposite the tension roller 49 without contact with the intermediate transfer section 40. After the secondary transfer, the noncontact biasing member 48 applies a bias voltage of opposite polarity to the toner (solid) in the liquid developer remaining on the intermediate transfer section 40. This neutralizes the toner, thus reducing the electrostatic attraction force exerted on the toner by the intermediate transfer section 40. In this example, the noncontact biasing member 48 used is a corona charger.

The noncontact biasing member 48 does not necessarily have to be disposed at a position opposite the tension roller 49, but may be disposed at any position downstream of the driven roller 44 in the movement direction of the intermediate transfer section 40 and upstream of the driven roller 45 in the movement direction of the intermediate transfer section 40, for example, somewhere between the driven roller 44 and the tension roller 49. In addition, the noncontact biasing member 48 used may be a known noncontact charger other than corona chargers.

In addition, an intermediate transfer section squeeze unit 52Y is disposed downstream of the primary transfer backup roller 51Y in the movement direction of the intermediate transfer section 40.

The intermediate transfer section squeeze unit 52Y is provided as a unit for removing excess liquid insulator from the liquid developer transferred onto the intermediate transfer section 40 if the transferred liquid developer is not in a desired dispersion condition.

The intermediate transfer section squeeze unit 52Y includes an intermediate transfer section squeeze roller 53Y, an intermediate transfer section squeeze cleaning blade 55Y for cleaning the surface of the intermediate transfer section squeeze roller 53Y by sliding thereover with pressure, and a developer collector 56Y for collecting the liquid developer removed by the intermediate transfer section squeeze cleaning blade 55Y.

The intermediate transfer section squeeze unit 52Y has the function of collecting excess liquid insulator from the developer primarily transferred onto the intermediate transfer section 40 to increase the proportion of toner particles in the image and also has the function of collecting unwanted fog toner.

The secondary transfer unit 60 includes a pair of secondary transfer rollers disposed at a predetermined distance from each other in the movement direction of the transfer material. Of the pair of secondary transfer rollers, the one disposed upstream in the movement direction of the intermediate transfer section 40 is an upstream secondary transfer roller 64. The upstream secondary transfer roller 64 can be pressed against the belt drive roller 41 with the intermediate transfer section 40 therebetween.

Of the pair of secondary transfer rollers, the one disposed downstream in the movement direction of the transfer material is a downstream secondary transfer roller 65. The downstream secondary transfer roller 65 can be pressed against the driven roller 44 with the intermediate transfer section 40 therebetween.

That is, the upstream secondary transfer roller 64 and the downstream secondary transfer roller 65 bring the recording medium F5 into contact with the intermediate transfer section 40 opposite the belt drive roller 41 and the driven roller 44, respectively, to secondarily transfer the intermediate transfer image, formed on the intermediate transfer section 40 by superimposing the images of different colors, onto the recording medium F5.

In this case, the belt drive roller 41 and the driven roller 44 also function as backup rollers for the upstream secondary transfer roller 64 and the downstream secondary transfer roller 65, respectively. That is, the belt drive roller 41 is also used as an upstream backup roller disposed upstream of the driven roller 44 in the movement direction of the recording medium F5 in the secondary transfer unit 60. On the other hand, the driven roller 44 is also used as a downstream backup roller disposed downstream of the belt drive roller 41 in the movement direction of the recording medium F5 in the secondary transfer unit 60.

Accordingly, the recording medium F5 transported to the secondary transfer unit 60 is brought into intimate contact with the intermediate transfer section 40 in a predetermined transfer material movement region from a pressing initiation position (nip initiation position) between the upstream secondary transfer roller 64 and the belt drive roller 41 to a pressing termination position (nip termination position) between the downstream secondary transfer roller 65 and the driven roller 44. This allows the full-color intermediate transfer image to be secondarily transferred from the intermediate transfer section 40 onto the recording medium F5 in intimate contact with the intermediate transfer section 40 over a predetermined period of time, thus enabling excellent secondary transfer.

In addition, the secondary transfer unit 60 includes a secondary transfer roller cleaning blade 66 and a developer collector 67 for the upstream secondary transfer roller 64. In addition, the secondary transfer unit 60 includes a secondary transfer roller cleaning blade 68 and a developer collector 69 for the downstream secondary transfer roller 65. The secondary transfer roller cleaning blades 66 and 68 abut the secondary transfer rollers 64 and 65, respectively, to scrape residual liquid developer off the surfaces of the secondary transfer rollers 64 and 65 after the secondary transfer. In addition, the developer collectors 67 and 69 collect and store the liquid developer scraped off the secondary transfer rollers 64 and 65 by the secondary transfer roller cleaning blades 66 and 68, respectively.

The toner image (transfer image) transferred onto the recording medium F5 by the secondary transfer unit 60 is transported to the fusing section (fusing unit) F40, which then fuses the image onto the recording medium F5 by heating and pressing.

Specifically, the fusion temperature is preferably 80° C. to 160° C., more preferably 100° C. to 150° C., and most preferably 100° C. to 140° C.

Next, the developing units 100Y, 100M, 100C, and 100K will be described in detail. In the description below, the developing unit 100Y will be described as a representative example.

As shown in FIG. 2, the developing unit 100Y includes a liquid developer reservoir 31Y, an application roller 32Y, a regulating blade 33Y, a developer stirring roller 34Y, a communication channel 35Y, a collecting screw propeller 36Y, a developing roller 20Y, and a developing roller cleaning blade 21Y.

The liquid developer reservoir 31Y has the function of storing the liquid developer for developing a latent image formed on the photoreceptor 10Y and includes a supply portion 31*a*Y for supplying the liquid developer to the application roller 32Y, a collecting portion 31*b*Y for collecting excess liquid developer from, for example, the supply portion 31*a*Y, and a partition 31*c*Y separating the supply portion 31*a*Y and the collecting portion 31*b*Y.

The supply portion 31*a*Y has the function of supplying the liquid developer to the application roller 32Y and has a recess where the developer stirring roller 34Y is disposed. In addition, the supply portion 31*a*Y is supplied with the liquid developer from a liquid developer mixing vessel 93Y through the communication channel 35Y.

The collecting portion 31*b*Y collects excess liquid developer supplied to the supply portion 31*a*Y and excess liquid developer collected by the developer collectors 15Y and 24Y. The collected liquid developer is transported to the liquid developer mixing vessel 93Y, described later, for reuse. In addition, the collecting portion 31*b*Y has a recess having the collecting screw propeller 36Y disposed near the bottom thereof.

The wall-shaped partition 31*c*Y is disposed at the boundary between the supply portion 31*a*Y and the collecting portion 31*b*Y. The partition 31*c*Y separates the supply portion 31*a*Y and the collecting portion 31*b*Y to prevent contamination of fresh liquid developer with the collected liquid developer. In addition, if excess liquid developer is supplied to the supply portion 31*a*Y, the excess liquid developer overflows from the supply portion 31*a*Y into the collecting portion 31*b*Y beyond the partition 31*c*Y. This maintains a constant amount of liquid developer in the supply portion 31*a*Y and therefore maintains a constant amount of liquid developer supplied to the application roller 32Y. Accordingly, the image finally formed has stable image quality.

In addition, the partition 31*c*Y has a cutaway through which the liquid developer overflows from the supply portion 31*a*Y into the collecting portion 31*b*Y.

The application roller 32Y has the function of supplying the liquid developer to the developing roller 20Y.

The application roller 32Y is one called an Anilox roller, that is, a metal roller, such as an iron roller, having grooves formed evenly and spirally on the surface thereof and plated with nickel, and has a diameter of about 25 mm. In this embodiment, the grooves are formed diagonally to the rotational direction of the application roller 32Y by, for example, cutting or form rolling. The application roller 32Y rotates counterclockwise while being in contact with the liquid developer to carry the liquid developer in the grooves thereof and transport it from the supply portion 31*a*Y to the developing roller 20Y.

The regulating blade 33Y abuts the surface of the application roller 32Y to regulate the amount of liquid developer on the application roller 32Y. That is, the regulating blade 33Y functions to scrape excess liquid developer off the application roller 32Y to regulate the amount of liquid developer on the application roller 32Y to be supplied to the developing roller 20Y. The regulating blade 33Y is formed of a urethane rubber, serving as an elastomer, and is supported by a regulating blade support member formed of a metal such as iron. The regulating blade 33Y is disposed on the side where the application roller 32Y emerges from the liquid developer as it rotates (that is, to the right in FIG. 2). The rubber of the regulating blade 33Y has a JIS-A hardness of about 77°. The hardness of the portion, abutting the surface of the application roller 32Y, of the regulating blade 33Y (about 77°) is lower than that of the portion, pressed against the surface of the application roller 32Y, of an elastic layer of the developing roller 20Y, described later (about 85°). The scraped excess liquid developer is collected by the supply portion 31*a*Y for reuse.

The developer stirring roller 34Y has the function of stirring the liquid developer to a uniformly dispersed state. This allows the toner particles to be well dispersed even after the toner particles are aggregated. In particular, liquid developers of the invention can be easily dispersed even after they are recycled because they have superior dispersion stability and redispersibility.

In the supply portion 31*a*Y, the toner particles in the liquid developer are positively charged, and the liquid developer is stirred to a uniformly dispersed state by the developer stirring roller 34Y. As the application roller 32Y rotates, the liquid developer is drawn from the liquid developer reservoir 31Y and is supplied to the developing roller 20Y after the amount of liquid developer is regulated by the regulating blade 33Y. In addition, the developer stirring roller 34Y stirs the liquid developer so that it can stably overflow into the collecting portion 31*b*Y beyond the partition 31*c*Y, thus preventing the liquid developer from being retained and compressed.

The developer stirring roller 34Y is disposed near the communication channel 35Y. Thus, the liquid developer supplied from the communication channel 35Y can be quickly diffused, and the liquid level in the supply portion 31*a*Y can be stabilized while the liquid developer is being supplied to the supply portion 31*a*Y, Being disposed near the communication channel 35Y, the developer stirring roller 34Y creates a negative pressure in the communication channel 35Y so that the liquid developer can be spontaneously pumped.

The communication channel 35Y is a channel provided vertically below the developer stirring roller 34Y so as to communicate with the liquid developer reservoir 31Y to pump the liquid developer from the liquid developer mixing vessel 93Y into the supply portion 31*a*Y.

Because the communication channel 35Y is provided below the developer stirring roller 34Y, the developer stirring roller 34Y interrupts the flow of liquid developer from the communication channel 35Y to maintain a substantially constant liquid level without a rise in liquid level due to ejection, thus stably supplying the developer to the application roller 32Y.

In addition, the collecting screw propeller 36Y, disposed near the bottom of the collecting portion 31*b*Y, is a cylindrical member having a spiral rib on the circumferential surface thereof and functions to maintain the liquidity of the collected liquid developer and to facilitate transportation of the liquid developer to the liquid developer mixing vessel 93Y.

The developing roller 20Y carries the liquid developer and transports it to a development position opposite the photoreceptor 10Y to develop a latent image carried on the photoreceptor 10Y with the liquid developer.

The liquid developer is supplied from the application roller 32Y described above to the surface of the developing roller 20Y to form a layer of the liquid developer.

The developing roller 20Y includes an inner core formed of a metal such as iron and a conductive elastic layer formed on the circumferential surface thereof and has a diameter of about 20 mm. The elastic layer has a double-layer structure including an inner layer formed of a urethane rubber having a JIS-A hardness of about 30° and having a thickness of about 5 mm and a surface layer (outer layer) formed of a urethane rubber having a JIS-A hardness of about 85° and having a thickness of about 30 μm. The surface layer, serving as the portion of the developing roller 20Y to be pressed, is pressed against the application roller 32Y and the photoreceptor 10Y so as to be elastically deformed.

The developing roller 20Y is rotatable about the central axis thereof, the central axis being positioned below the central axis of rotation of the photoreceptor 10Y. The developing roller 20Y rotates in a direction (counterclockwise in FIG. 2) opposite to the rotational direction (clockwise in FIG. 2) of the photoreceptor 10Y. An electric field is generated between the developing roller 20Y and the photoreceptor 10Y to develop a latent image formed on the photoreceptor 10Y.

In the developing unit 100Y, the application roller 32Y and the developing roller 20Y are separately driven by different power sources (not shown). Accordingly, the amount of liquid developer supplied to the developing roller 20Y can be adjusted by changing the ratio between the rotational speeds (linear speeds) of the application roller 32Y and the developing roller 20Y.

In addition, the developing unit 100Y includes a rubber developing roller cleaning blade 21Y abutting the surface of the developing roller 20Y and a developer collector 24Y. The developing roller cleaning blade 21Y is a unit for scraping residual liquid developer off the developing roller 20Y after development at the development position. The developer collector 24Y collects the liquid developer scraped off by the developing roller cleaning blade 21Y.

As shown in FIGS. 1 and 2, additionally, the image-forming apparatus 1000 includes liquid developer supply sections 90Y, 90M, 90C, and 90K for supplying the liquid developers to the developing sections 30Y, 30M, 30C, and 30K, respectively. The liquid developer supply sections 90Y, 90M, 90C, and 90K include, respectively, liquid developer tanks 91Y, 91M, 91C, and 91K, liquid insulator tanks 92Y, 92M, 92C, and 92K, and liquid developer mixing vessels 93Y, 93M, 93C, and 93K.

The liquid developer tanks 91Y, 91M, 91C, and 91K contain concentrated liquid developers of the corresponding colors. The liquid insulator tanks 92Y, 92M, 92C, and 92K contain liquid insulators. The liquid developer mixing vessels 93Y, 93M, 93C, and 93K are supplied with predetermined amounts of concentrated liquid developers from the liquid developer tanks 91Y, 91M, 91C, and 91K and are supplied with predetermined amounts of liquid insulators from the liquid insulator tanks 92Y, 92M, 92C, and 92K.

The liquid developer mixing vessels 93Y, 93M, 93C, and 93K mix and stir the supplied concentrated liquid developers and liquid insulators with built-in mixers to prepare the liquid developers of the corresponding colors to be used in the supply portions 31*a*Y, 31*a*M, 31*a*C, and 31*a*K. The liquid developers prepared in the liquid developer mixing vessels 93Y, 93M, 93C, and 93K are supplied to the supply portions 31*a*Y, 31*a*M, 31*a*C, and 31*a*K, respectively.

In addition, the liquid developer mixing vessels 93Y, 93M, 93C, and 93K collect the liquid developers collected by the collecting portions 31*b*Y, 31*b*M, 31*b*C, and 31*b*K, respectively, for reuse. The toner particles, as described above, are prepared by modifying the surfaces of mother toner particles containing a rosin-based resin with a polyalkyleneimine, and the polyalkyleneimine combines firmly with the surfaces of the mother toner particles. Accordingly, even if the toner particles are exposed to stress during the collection (for example, stress applied by the cleaning blades), the polyalkyleneimine is reliably prevented from coming off from the mother toner particles. In addition, the above toner particles are highly redispersible in the liquid insulator. Thus, the collected toner particles can be appropriately reused for image formation.

Whereas the invention has been described above on the basis of preferred embodiments, the invention is not limited thereto.

For example, the invention is not limited to liquid developers applicable to the image-forming apparatus as described above.

In addition, the invention is not limited to liquid developers produced by the method as described above. For example, a liquid developer may be produced by crushing a material containing a rosin-based resin and a polyester resin in a liquid insulator containing a polyalkyleneimine by a wet process.

In addition, although coalesced particles are formed by preparing an aqueous emulsion and adding an electrolyte to the aqueous emulsion in the embodiment described above, the invention is not limited thereto, For example, coalesced particles may be formed by emulsion aggregation, a method in which a colorant, a monomer, a surfactant, and a polymerization initiator are dispersed in an aqueous liquid to prepare an aqueous emulsion by emulsion polymerization and an electrolyte is then added to the aqueous emulsion to cause aggregation, or may be formed by subjecting the resultant aqueous emulsion to spray drying.

In addition, although the image-forming apparatus of the embodiment described above includes a corona charger, it may be omitted.

EXAMPLES

1. Production of Liquid Developer

Liquid developers were produced as follows, where the individual steps were carried out at room temperature (25° C.) unless otherwise specified.

Example 1

Dispersion Preparation Step

Aqueous Dispersion Preparation Step

Preparation of Colorant Masterbatch

First, 60 parts by weight of a polyester resin (acid value: 10 mg KOH/g; glass transition point (Tg): 55° C.; softening point: 107° C.) was prepared as a resin material.

Next, the above resin material was mixed with a cyan pigment (Pigment Blue 15:3, manufactured by Dainichiseika Color & Chemicals Mfg. Co., Ltd.), serving as a colorant, in a mass ratio of 50:50. These components were mixed using a 20 L HENSCHEL MIXER to prepare a raw material for production of toner.

Next, the raw material (mixture) was kneaded using a double-screw kneading and extruding machine. The kneaded material extruded from an extrusion port of the double-screw kneading and extruding machine was cooled.

The kneaded material cooled as described above was roughly crushed to prepare a colorant masterbatch having an average particle size of not more than 1.0 mm. The kneaded material was roughly crushed using a hammer mill.

Resin Solution Preparation Step

A resin solution was prepared by mixing 97.5 parts by weight of the above colorant masterbatch with 175 parts by weight of methyl ethyl ketone, 172.3 parts by weight of the above polyester resin, and 55.3 parts by weight of a rosin-modified maleic resin (the trade name "MALKYD No. 1", manufactured by Arakawa Chemical Industries, Ltd.; acid value: 25 mg KOHIg or less; softening point: 120° C. to 130° C.; weight average molecular weight: 3,100) using a high-speed disperser (TX. ROBOMIX/T.K. HOMO DISPER Model 2.5, manufactured by PRIMIX Corporation) and then adding 1.38 parts by weight of an emulsifier (the trade name "NEOGEN SC-F", manufactured by Dai-lchi Kogyo Seiyaku Co., Ltd.). In this solution, the pigment was finely dispersed evenly.

O/W Emulsion Preparation Step

Next, an O/W emulsion in which dispersoids containing the resin material were dispersed was prepared through the formation of an W/O emulsion by adding 72.8 parts by weight of 1 N aqueous ammonia to the resin solution in the container, sufficiently stirring the solution using a high-speed disperser (T.K. ROBOMIX/T.K. HOMO DISPER Model 2.5, manufactured by PRIMIX Corporation) at an impeller tip speed of 7.5 m/s, adjusting the temperature of the solution in the flask to 25° C., adding 400 parts by weight of deionized water dropwise with stirring at an impeller tip speed of 14.7 m/s, and adding 100 parts by weight of deionized water while continuing stirring.

Coalescence Step

Next, the O/W emulsion was transferred into a stirring container equipped with a MAXBLEND IMPELLER, and the temperature of the O/W emulsion was adjusted to 25° C. with stirring at an impeller tip speed of 1.0 m/s. Next, the dispersoids were coalesced by adding 200 parts by weight of a 5.0% aqueous sodium sulfate solution dropwise under the same temperature and stirring conditions to form coalesced particles. After the solution was added dropwise, stirring was continued until the coalesced particles grew to a 50% volume particle size Dv(50) (km) of 2.5 μm. After the coalesced particles grew to a Dv(50) of 2.5 μm, the coalescence was terminated by adding 200 parts by weight of deionized water.

Organic Solvent Removal Step

Next, the O/W emulsion containing the coalesced particles was placed under reduced pressure to remove the organic solvent until the solid content thereof reached 23% by weight. Thus, a slurry (dispersion) of mother toner particles was obtained.

Cleaning Step (First Cleaning Step)

Next, the slurry (dispersion) was cleaned by repeating solid-liquid separation and redispersion in water (reslurrying). The cleaning was continued until a supernatant liquid taken from the slurry had a conductivity of 20 μS/cm or less.

Subsequently, a wet cake of mother toner particles (mother toner particle cake) was obtained by suction filtration. The wet cake was then dispersed in water. Thus, a dispersion (aqueous dispersion) containing the cleaned mother toner particles was obtained.

Surface Modification Step

Next, the pH of the dispersion (aqueous dispersion) containing the cleaned mother toner particles was adjusted to 4.0 by adding 1 N hydrochloric acid.

Subsequently, the dispersion (aqueous dispersion) whose pH was adjusted to 4.0 was stirred while adding polyethyleneimine (weight average molecular weight: 70,000) dropwise. The polyethyleneimine was added in an amount of 1.0 part by weight on the basis of 100 parts by weight of the rosin-based resin. The dispersion was then sufficiently stirred so that the composition of the entire dispersion became sufficiently uniform.

Cleaning Step (Second Cleaning Step)

Next, the dispersion in which the toner particles were dispersed was cleaned by repeating solid-liquid separation and redispersion in water (reslurrying). Subsequently, a wet cake of toner particles (toner particle cake) was obtained by suction filtration. The wet cake thus obtained had a water content of 35% by weight. When the liquid phase and filtrate separated by solid-liquid separation were examined, no polyethyleneimine was detected therein.

Drying Step

Subsequently, the resultant wet cake was dried using a vacuum dryer. Thus, toner particles formed by modifying (chemically modifying) the surfaces of the mother toner particles with polyethyleneimine were obtained.

Liquid Insulator Dispersion Step

Placed in a ceramic pot (internal volume: 600 mL) were 50 parts by weight of the toner particles prepared by the method described above, a mixture of 198 parts by weight of ISOPAR H (trade name of ExxonMobil Chemical Company) and 2 parts by weight of NIKKA OCTHIX Zirconium 12% (2 parts by weight as zirconium octyiate), serving as a liquid insulator, and 2.5 parts by weight of ARAKYD 251 (manufactured by Arakawa Chemical Industries, Ltd.), serving as a dispersant. Then, zirconia balls (ball diameter: 1 mm) were placed in the ceramic pot in a volume percentage of 85%, and the mixture was subjected to dispersion using a tabletop pot mill at a rotational speed of 230 rpm for 24 hours. Thus, a liquid developer was obtained.

The 50% volume particle size Dv(50) of the toner particles in the resultant liquid developer was 1.95 μm, where the Dv(50) (μm) of the resultant toner particles was measured using Microtrac MT-3000 (manufactured by Nikkiso Co., Ltd.). Similarly, the particle sizes of the particles prepared in the examples and comparative examples described below were measured.

Also, a magenta liquid developer, a yellow liquid developer, and a black liquid developer were produced in the same manner as above except that the cyan pigment was replaced with a magenta pigment, namely, Pigment Red 238 (manufactured by Sanyo Color Works, Ltd.), a yellow pigment, namely, Pigment Yellow 180 (manufactured by Clariant Corporation), and a black pigment, namely, carbon black (PRINTEX L, manufactured by Degussa AG), respectively.

Examples 2 to 16

Liquid developers of the individual colors were produced in the same manner as in Example 1 except that the type of resin material, the type and amount of polyalkyleneimine used, the type of liquid insulator, the type and amount of metal soap added, and the type and amount of dispersant added were changed as in Table 1.

Comparative Example 1

Liquid developers of the individual colors were produced in the same manner as in Example 2 except that no rosin-based resin was used and the amount of polyester resin used was correspondingly increased. When the liquid phase and filtrate separated by solid-liquid separation were examined in the cleaning step (second cleaning step), it was found that the polyalkyleneimine was contained therein.

Comparative Example 2

Liquid developers of the individual colors were produced in the same manner as in Example 2 except that the step of chemical modification with the polyalkyleneimine was not carried out.

Comparative Example 3

Liquid developers of the individual colors were produced in the same manner as in Example 2 except that no metal soap was added.

Table 1 shows the types of resin material, polyalkyleneimine, and liquid insulator used for preparation of the liquid developers and the types and amounts of metal soap and dispersant added in Examples and Comparative Examples above. In Table 1, RPES denotes a rosin-modified polyester resin (the trade name "TFS-015", manufactured by Arakawa Chemical Industries, Ltd.; acid value: 11.8 mg KOH/g; softening point: 79° C.; weight average molecular weight: 1,300), RPH denotes a rosin-modified phenolic resin (the trade name "TAMANOL 135", manufactured by Arakawa Chemical Industries, Ltd.; acid value: 18 mg KOH/g or less; softening point: 130° C. to 140° C.; weight average molecular weight: 15,000), RM denotes a rosin-modified maleic resin (the trade name "MALKYD No. 1", manufactured by Arakawa Chemical Industries, Ltd.; acid value: 25 mg KOH/g or less; softening point: 120° C. to 130° C.; weight average molecular weight: 3,100), PEI denotes polyethyleneimine, P-60 denotes liquid paraffin A (the trade name "COSMOWHITE P-60", manufactured by Cosmo Oil Lubricants Co., Ltd.), OZ denotes NIKKA OCTHIX Zirconium 12% (manufactured by Nihon Kagaku Sangyo Co., Ltd.), NZ denotes NAPHTHEX Zirconium 4% (manufactured by Nihon Kagaku Sangyo Co., Ltd.), OC denotes NIKKA OCTHIX Cobalt 8% (manufactured by Nihon Kagaku Sangyo Co., Ltd.), 251 denotes ARAKYD 251, and 108 denotes DISPERBYK-108 (manufactured by BYK Japan KK; amine value: 71).

TABLE 1

| | Liquid developer | | | | | | | | | | | |
|---|---|---|---|---|---|---|---|---|---|---|---|---|
| | Mother toner particle | | | | Polyalkyleneimine | | | | | | | |
| | Resin material | | | | | | Amount used on basis of 100 parts by weight of | | Metal soap | | Dispersant | |
| | Rosin-based resin | | Polyester resin | | | | | | | | | |
| | Type | Content in resin material (wt %) | Content in resin material (wt %) | Chemical modification with polyalkyleneimine | Type | Weight average molecular weight | rosin-based resin (part by weight) | Type of liquid insulator | Type | Content in liquid insulator (wt %) | Type | Content in liquid developer (wt %) |
| Ex. 1 | RM | 20 | 80 | Modified | PEI | 70,000 | 1.0 | Isopar H | OZ | 1 | 251 | 1 |
| Ex. 2 | RM | 20 | 80 | Modified | PEI | 70,000 | 1.0 | Isopar H | OZ | 1 | — | — |
| Ex. 3 | RM | 20 | 80 | Modified | PEI | 70,000 | 1.0 | Isopar H | OZ | 5 | — | — |
| Ex. 4 | RM | 20 | 80 | Modified | PEI | 70,000 | 1.0 | Isopar H | OZ | 7 | — | — |
| Ex. 5 | RM | 20 | 80 | Modified | PEI | 70,000 | 1.0 | Isopar H | OZ | 10 | — | — |
| Ex. 6 | RM | 20 | 80 | Modified | PEI | 70,000 | 1.0 | Isopar H | OZ | 1 | 108 | 1 |
| Ex. 7 | RM | 20 | 80 | Modified | PEI | 70,000 | 1.0 | Isopar H | NZ | 1 | — | — |
| Ex. 8 | RM | 20 | 80 | Modified | PEI | 70,000 | 1.0 | Isopar H | OC | 1 | — | — |
| Ex. 9 | RM | 20 | 80 | Modified | PEI | 70,000 | 1.0 | P-60 | OZ | 1 | 251 | 1 |
| Ex. 10 | RM | 20 | 80 | Modified | PEI | 70,000 | 1.0 | P-60 | NZ | 1 | — | — |
| Ex. 11 | RM | 20 | 80 | Modified | PEI | 70,000 | 1.0 | P-60 | OC | 1 | — | — |
| Ex. 12 | RM | 20 | 80 | Modified | PEI | 10,000 | 1.0 | Isopar H | OZ | 1 | 251 | 1 |
| Ex. 13 | RM | 20 | 80 | Modified | PEI | 1,800 | 1.0 | Isopar H | OZ | 1 | 251 | 1 |
| Ex. 14 | RM | 20 | 80 | Modified | PEI | 600 | 1.0 | Isopar H | OZ | 1 | 251 | 1 |
| Ex. 15 | RPH | 20 | 80 | Modified | PEI | 70,000 | 1.0 | Isopar H | OZ | 1 | 251 | 1 |
| Ex. 16 | RPES | 20 | 80 | Modified | PEI | 70,000 | 1.0 | Isopar H | OZ | 1 | 251 | 1 |
| Com. Ex. 1 | — | — | 100 | Modified | PEI | 70,000 | 1.0 | Isopar H | OZ | 1 | — | — |
| Com. Ex. 2 | RM | 20 | 80 | Unmodified | — | — | — | Isopar H | OZ | 1 | — | — |
| Com. Ex. 3 | RM | 20 | 80 | Modified | PEI | 70,000 | 1.0 | Isopar H | — | — | — | — |

2. Evaluation

The individual liquid developers prepared as described above were evaluated as follows.

2.1 Dielectric Constant Measurement

Each liquid developer prepared in Examples and Comparative Examples was separated into a liquid component and a solid component by centrifugal separation.

The liquid component was put into the measurement container LP-05 (manufactured by Kawaguchi Electric Works Co., Ltd.). The capacitance of the liquid component was measured by supplying a sinusoidal alternating current with a frequency of 1 kHz and a voltage of 1 Vpp using Chemical Impedance Meter 3532-80 (manufactured by Hioki E.E. Corporation), and the dielectric constant A thereof was calculated.

In addition, the resin contained in the solid component was dissolved in THF, and the solution was applied to an aluminum-deposited PET film (PET thickness: 120 μm) using a spin coater to form a film (thickness: 12 μm) thereon. Electrodes were then formed thereon by depositing gold films. The capacitance of the sheet sample was measured by supplying a sinusoidal alternating current with a frequency of 1 kHz and a voltage of 1 Vpp using Chemical Impedance Meter 3532-80, and the dielectric constant B thereof was calculated.

The ratio of the dielectric constant A to the dielectric constant B (A/B) was calculated. The ratio A/B is shown in Table 2.

2.2 Evaluation of Charging Properties

Each liquid developer prepared in Examples and Comparative Examples was dropped between two tungsten wires (diameter: 0.2 mm) bonded to a glass plate at a distance of 1.0 mm, and a glass cover was placed thereon. An image of the sample was captured from above using the microscope VH-7000 (manufactured by Keyence Corporation), where a high-speed camera (FASTCAM MC2, manufactured by Photoron Limited) was used for image capturing. The electrophoretic speed of the fine particles in the liquid developer was measured by applying a voltage across the two tungsten wires using the NF4305 high-voltage power supply (manufactured by NF Corporation), and the mobility thereof was calculated. The absolute value of mobility is shown in Table 2.

2.3 Evaluation of Dispersibility

The shear viscosities of each liquid developer prepared in Examples and Comparative Examples at shear rates of 1 $sec^{-1}$ and 10 $sec^{-1}$ ($\eta_b$ and $\eta_{10}$, respectively) were measured using the cone-plate viscometer TV-22L (manufactured by Toki Sangyo Co., Ltd.), and the viscosity ratio thereof ($\eta_1/\eta_{10}$) was used for evaluation, where a ratio of not less than and closer to 1 indicates a higher dispersibility.

2.4 Development Efficiency

Using an image-forming apparatus as shown in FIGS. 1 and 2, a liquid developer layer of each liquid developer prepared in Examples and Comparative Examples was formed on a developing roller of the image-forming apparatus. A photoreceptor was then uniformly charged to a surface potential of 500 V, with the developing roller charged to a surface potential of 300 V, and was exposed to attenuate the charge on the surface of the photoreceptor to a surface potential of 50 V. After the liquid developer passed between the photoreceptor and the developing roller, toner particles on the developing roller and toner particles on the photoreceptor were collected with tapes. The tapes used for collection were laminated on recording paper, and the concentrations of the toner particles were measured. After the measurement, the development efficiency was calculated by dividing the concentration of the toner particles collected from the photoreceptor by the sum of the concentration of the toner particles collected from the photoreceptor and the concentration of the toner particles collected from the developing roller and then multiplying it by 100. The development efficiency was evaluated according to the following four criteria:

A: The development efficiency was 98% or more, that is, particularly superior.

B: The development efficiency was 95% to less than 98%, that is, superior.

C: The development efficiency was 90% to less than 95%, that is, practically acceptable.

D: The development efficiency was less than 90%, that is, inferior.

2.5 Positive Charging Properties

The potential difference of each liquid developer prepared in Examples and Comparative Examples was measured using a microscope-type laser zeta potential analyzer (ZC-2000, manufactured by Microtec Nition Co., Ltd.).

In the measurement, the liquid developer was diluted with a diluent solvent and was placed in a 10 mm square transparent cell. While a voltage of 300 V was applied at an interelectrode distance of 9 mm, the migration of the particles in the cell was observed by microscopy to calculate the migration speed. The zeta potential was then calculated from the measurement. The potential difference was evaluated according to the following four criteria:

A: The potential difference was +100 mV or more (excellent).

B: The potential difference was +85 mV to less than +100 mV (good).

C: The potential difference was +70 mV to less than +85 mV (fair).

D: The potential difference was +50 mV to less than +70 mV (poor).

E: The potential difference was less than +50 mV (terrible).

TABLE 2

| | A/B | Mobility | $\eta_1/\eta_{10}$ | Development efficiency | Positive charging properties |
|---|---|---|---|---|---|
| Ex. 1 | 0.95 | 1.8 | 1.16 | A | A |
| Ex. 2 | 0.95 | 1.7 | 1.29 | A | B |
| Ex. 3 | 0.98 | 1.7 | 1.29 | B | A |
| Ex. 4 | 1.02 | 1.0 | 1.25 | B | A |
| Ex. 5 | 1.25 | 1.2 | 1.25 | B | A |
| Ex. 6 | 0.95 | 1.5 | 1.23 | C | B |
| Ex. 7 | 0.91 | 1.3 | 1.29 | B | A |
| Ex. 8 | 0.94 | 1.5 | 1.29 | B | A |
| Ex. 9 | 0.94 | 1.8 | 1.18 | A | A |
| Ex. 10 | 0.93 | 1.5 | 1.28 | B | B |
| Ex. 11 | 0.93 | 1.5 | 1.28 | B | B |
| Ex. 12 | 0.95 | 1.8 | 1.29 | A | A |
| Ex. 13 | 0.95 | 1.5 | 1.31 | A | B |
| Ex. 14 | 0.95 | 1.5 | 1.32 | A | B |
| Ex. 15 | 0.95 | 1.8 | 1.17 | A | A |
| Ex. 16 | 0.95 | 1.8 | 1.16 | A | A |
| Com. Ex. 1 | 0.94 | 1.1 | 1.40 | C | E |
| Com. Ex. 2 | 0.94 | 0.8 | 1.66 | C | E |
| Com. Ex. 3 | 0.73 | 0.3 | 1.35 | D | C |

As is obvious from Table 2, the liquid developers of the examples of the invention had superior charging properties (positive charging properties), superior development efficiency, and superior dispersion stability of toner particles. In contrast, the liquid developers of the comparative examples did not achieve satisfactory results.

In addition, images were continuously formed on 50,000 sheets of recording paper (the high-quality paper LPCPPA4, manufactured by Seiko Epson Corporation) using an image-forming apparatus as shown in FIGS. 1 and 2 by supplying the liquid developers from liquid developer mixing vessels for the respective colors to supply sections for the respective colors. As a result, for the liquid developers of the examples of the invention, an image with high quality could be formed on the 50,000th sheet, and no decrease in image quality was found. In contrast, for the liquid developers of the comparative examples, a remarkable decrease in image quality was found.

The entire disclosure of Japanese Patent Application No. 2010-010504, filed Jan. 20, 2010 is expressly incorporated by reference herein.

What is claimed is:

1. A liquid developer comprising;

a liquid insulator formed of a liquid hydrocarbon;

toner particles formed by chemically modifying surfaces of mother toner particles formed of a material containing a rosin-based resin and a polyester resin with a polyalkyleneimine; and a metal soap dissolved in the liquid insulator.

2. The liquid developer according to claim 1, wherein the relationship $0.8 \leq A/B \leq 1.0$ is satisfied, where A is the dielectric constant of the liquid insulator in which the metal soap is dissolved and B is the dielectric constant of the toner particles.

3. The liquid developer according to claim 1, wherein the content of the metal soap in the liquid insulator in which the metal soap is dissolved is 0.1% to 10% by weight.

4. The liquid developer according to claim 1, wherein the metal soap is zirconium octoate.

5. The liquid developer according to claim 1, wherein the polyalkyleneimine has a weight average molecular weight of 600 to 200,000.

6. The liquid developer according to claim 1, wherein the polyalkyleneimine is polyethyleneimine.

7. The liquid developer according to claim 1, further comprising a dispersant having an amine value of zero.

* * * * *